US011708996B2

(12) United States Patent
Tobbe

(10) Patent No.: US 11,708,996 B2
(45) Date of Patent: Jul. 25, 2023

(54) AIR CONDITIONING APPLIANCE HAVING A WEATHER-RESISTANT ELECTRONICS CASING

(71) Applicant: Haier US Appliance Solutions, Inc., Wilmington, DE (US)

(72) Inventor: Joseph Robert Tobbe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 69 days.

(21) Appl. No.: 17/389,616

(22) Filed: Jul. 30, 2021

(65) Prior Publication Data

US 2023/0033829 A1 Feb. 2, 2023

(51) Int. Cl.

| | |
|---|---|
| ***F24F 11/88*** | (2018.01) |
| ***F24F 13/30*** | (2006.01) |
| ***F24F 1/029*** | (2019.01) |
| ***F24F 13/20*** | (2006.01) |

(52) U.S. Cl.

CPC ..... *F24F 11/88* (2018.01); *F24F 1/029* (2019.02); *F24F 13/20* (2013.01); *F24F 13/30* (2013.01); *F24F 2221/52* (2013.01)

(58) Field of Classification Search

CPC .... F24F 11/88; F24F 1/029; F24F 1/24; F24F 1/22; F24F 13/20; F24F 13/30; F24F 2221/52

See application file for complete search history.

(56) References Cited

U.S. PATENT DOCUMENTS

| | | | | |
|---|---|---|---|---|
| 10,398,021 | B2 * | 8/2019 | Avalos | H05K 1/0206 |
| 2003/0184969 | A1 * | 10/2003 | Itabashi | H01L 23/3675 361/688 |
| 2010/0226104 | A1 | 9/2010 | Takeichi et al. | |
| 2013/0250521 | A1 * | 9/2013 | Kawai | H05K 7/20854 361/714 |

FOREIGN PATENT DOCUMENTS

| | | | |
|---|---|---|---|
| EP | 2525158 | A2 | 11/2012 |
| WO | WO2013005810 | A1 | 1/2013 |

* cited by examiner

*Primary Examiner* — Emmanuel E Duke
(74) *Attorney, Agent, or Firm* — Dority & Manning, P.A.

(57) ABSTRACT

A single-package air conditioner unit may include, a housing, an outdoor heat exchanger assembly, an indoor heat exchanger assembly, a compressor, an electronics casing, and an electronics board. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The electronics casing may be disposed in the outdoor portion apart from the outdoor heat exchanger. The electronics casing may define a board chamber in which the electronics board may be mounted.

20 Claims, 8 Drawing Sheets

AIR CONDITIONING APPLIANCE HAVING A WEATHER-RESISTANT ELECTRONICS CASING

FIELD OF THE INVENTION

The present subject matter relates generally to air conditioning appliances, and more particularly to appliances having a weather-resistant electronics casing for keeping certain elements dry (e.g., within the appliance).

BACKGROUND OF THE INVENTION

Air conditioner or air conditioning appliance units are conventionally used to adjust the temperature within structures such as dwellings and office buildings. In particular, one-unit type room air conditioner units, such as single-package vertical units (SPVU), may be used to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through the indoor portion of the air conditioner unit. One or more electronic boards (e.g., control or inverter boards) are typically provided to direct the operation of various elements of the particular air conditioner unit and, for instance, supply power to the same.

Although such electronics boards are generally necessary for the operation of modern air conditioner units, difficulties may arise with mounting the same. For instance, it may be useful to hold a heat-generating electronics board away from path for indoor air, or outside of the indoor portion in general. Unfortunately, though, this risks exposing the electronics board to moisture (e.g., such as from air humidity or liquid water that is sprayed to the outdoor portion, such as through a plenum). Although resilient gaskets may be provided to seal an electronics board within a casing, such arrangements might be susceptible to failure, especially if one or more resilient gaskets start to deteriorate over time. Additionally or alternatively, heat may become trapped within the casing of such arrangements, risking damage to the electronics board. Moreover, adding the necessary elements to seal the casing may also add to the expense or difficulties for manufacturing the appliance.

As a result, it would be useful to have an appliance or casing providing for suitable mounting of an electronics casing. In particular, it may be advantageous to protect an electronics board or otherwise mitigate the risk of water damage to the same (e.g., in a reliable, low-cost, or easily assembled manner).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner unit is provided. The single-package air conditioner unit may include, a housing, an outdoor heat exchanger assembly, an indoor heat exchanger assembly, a compressor, an electronics casing, a metal heat sink, and an electronics board. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The electronics casing may be disposed in the outdoor portion apart from the outdoor heat exchanger. The electronics casing may define a board chamber and include an angled casing wall extending along a wall angle that is non-orthogonal and non-parallel relative to a vertical direction. The metal heat sink may include a plurality of fins mounted to the angled casing wall and extend away from the board chamber. The electronics board may be mounted within the board chamber in thermal communication with the metal heat sink.

In another exemplary aspect of the present disclosure, a single-package air conditioner unit is provided. The single-package air conditioner unit may include, a housing, an outdoor heat exchanger assembly, an indoor heat exchanger assembly, a compressor, an electronics casing, a casing lid, and an electronics board. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The electronics casing may be disposed in the outdoor portion apart from the outdoor heat exchanger. The electronics casing may extend along the vertical direction between a top casing end and a bottom casing end. The electronics casing may define a board chamber between the top casing end and the bottom casing end. The electronics casing may include a plurality of sidewalls defining a vertical opening and a horizontal channel at the top casing end. The vertical opening may permit access to the electronics casing. The electronics casing may further define a weep hole extending from the board chamber to the outdoor portion at the bottom casing end to permit liquids to pass from the board chamber. The casing lid may selectively cover the vertical opening. The casing lid may include an upper platform and an internal rim extending downward from the upper platform along the plurality of sidewalls. The electronics board may be mounted within the board chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
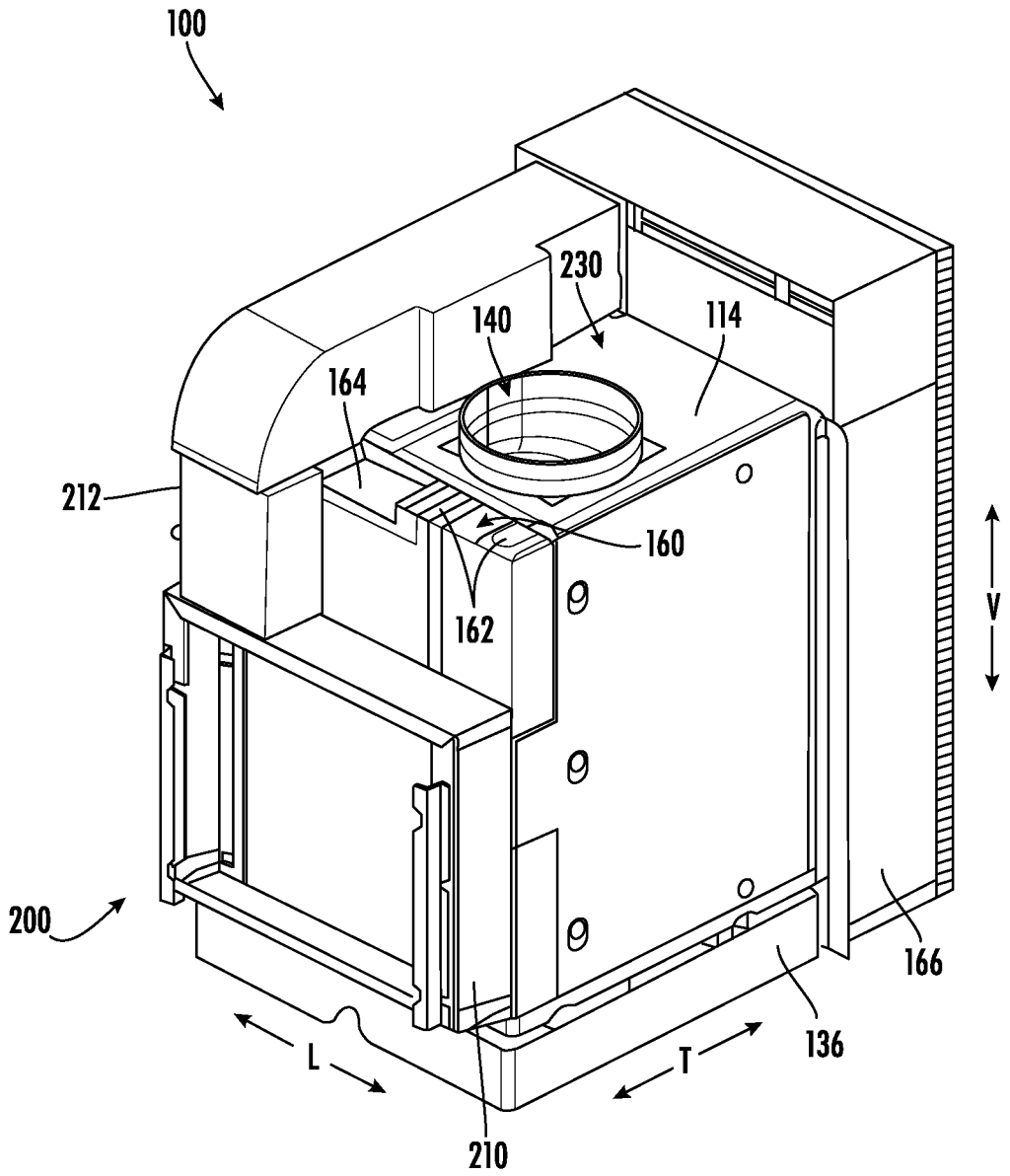
FIG. 1 provides a perspective view of an air conditioning appliance according to exemplary embodiments of the present disclosure.
Figure 2:
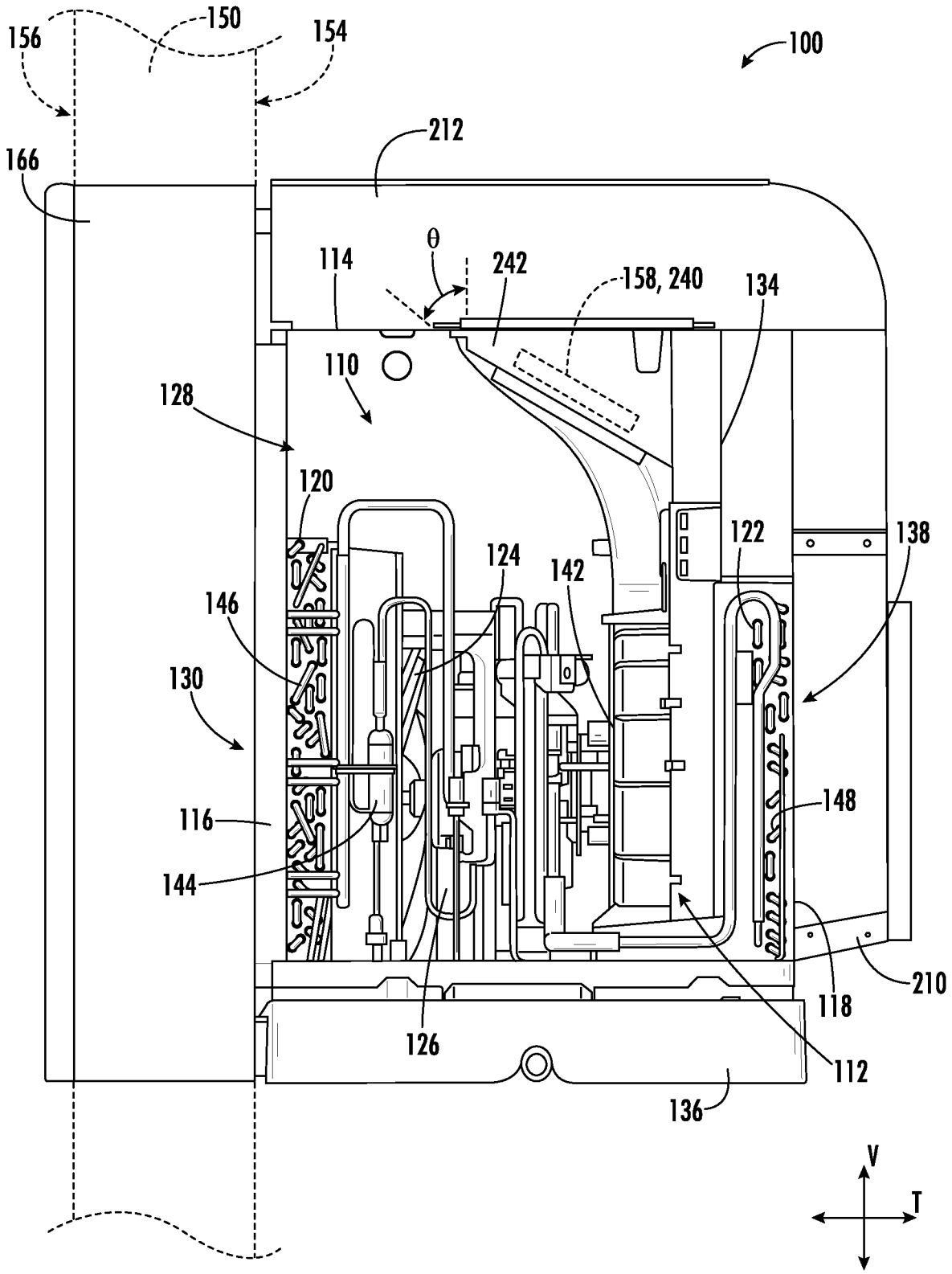
FIG. 2 provides a partially-transparent elevation view of the exemplary air conditioner unit of FIG. 1.
Figure 3:
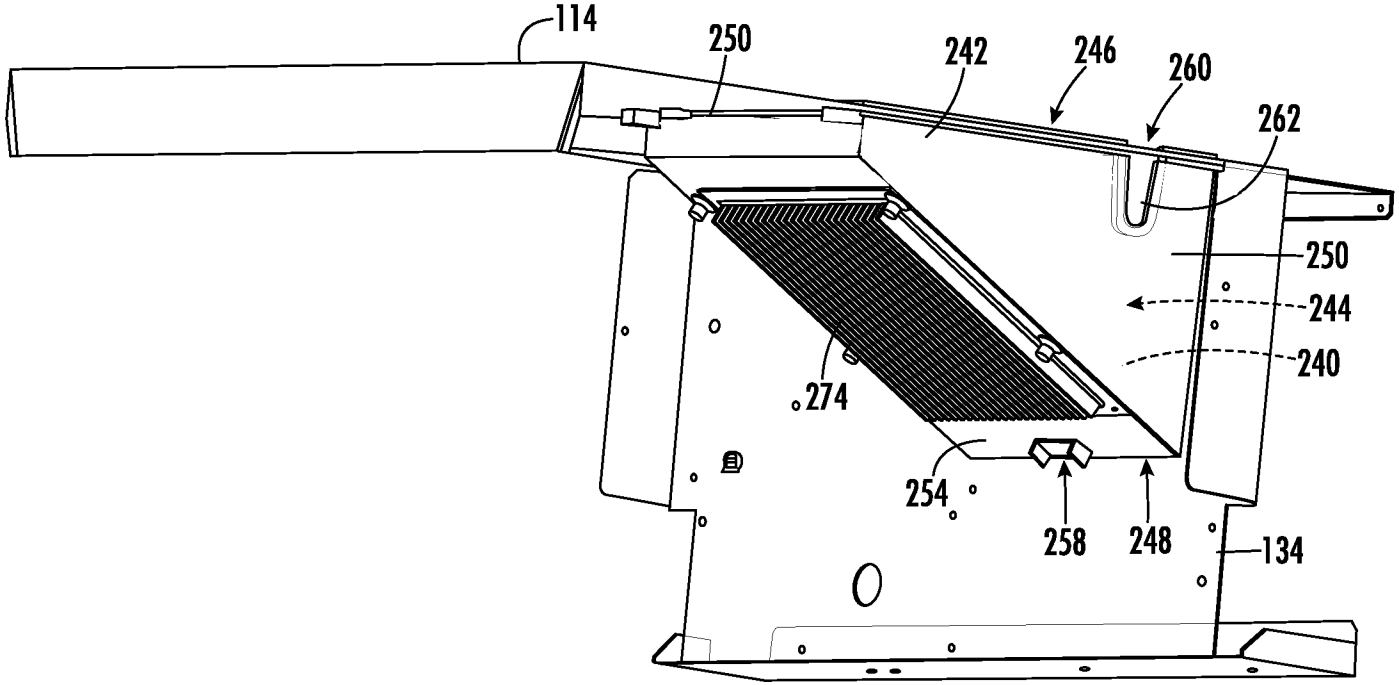
FIG. 3 provides a perspective view of a casing assembly of the exemplary air conditioner unit of FIG. 1.
Figure 4:
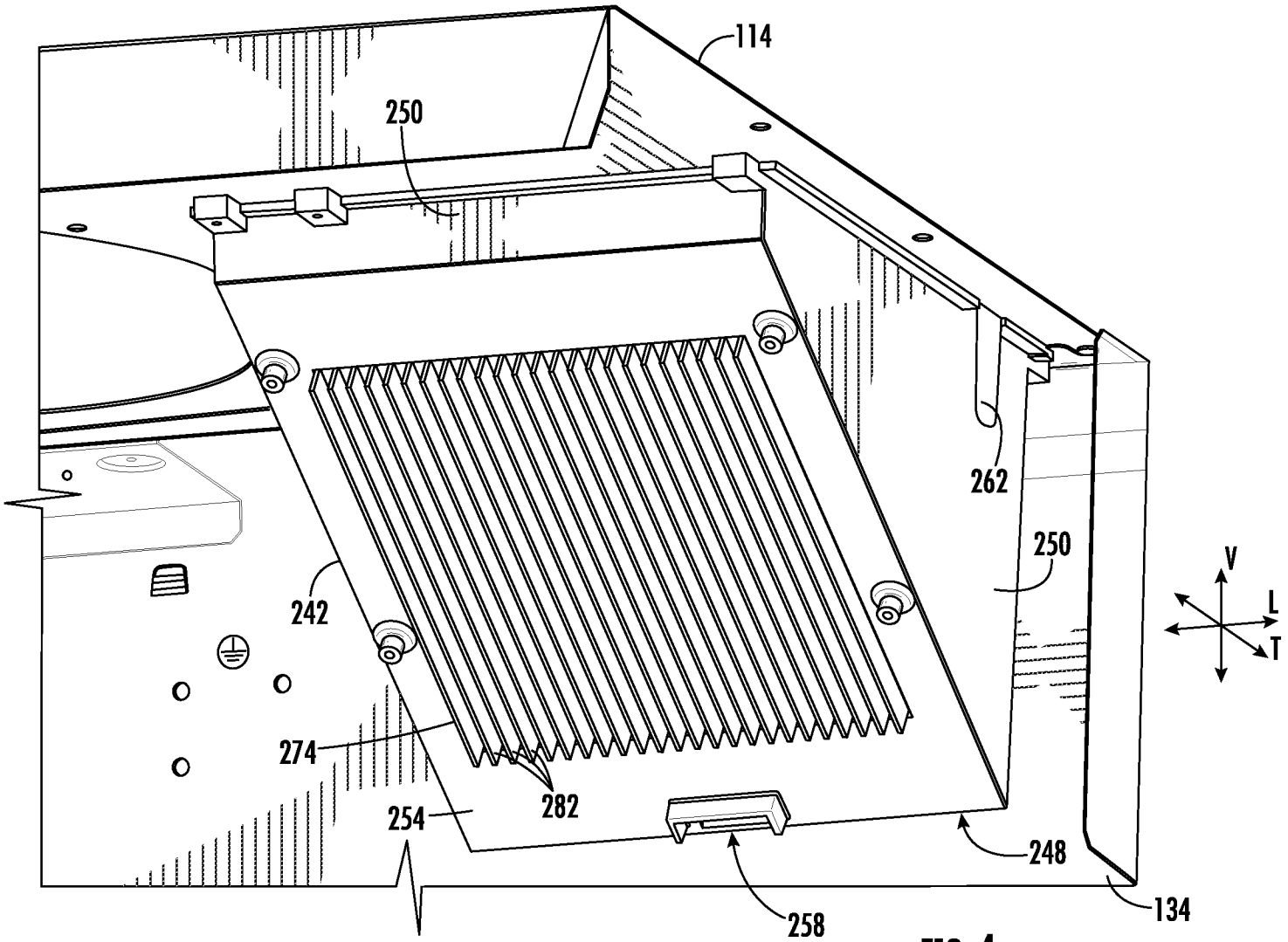
FIG. 4 provides a magnified perspective view of the exemplary casing assembly of FIG. 3.
Figure 5:
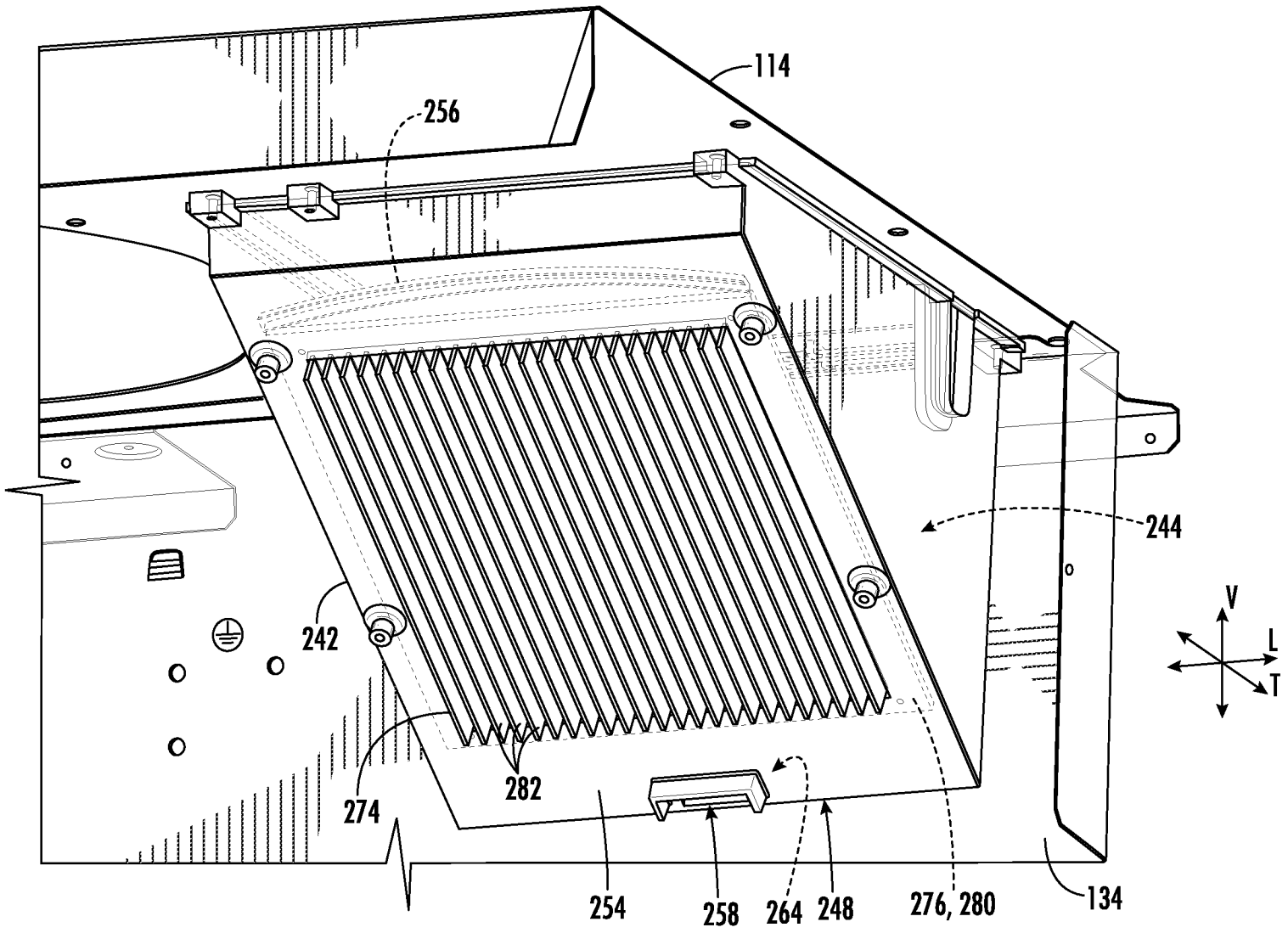
FIG. 5 provides a partially transparent, magnified, perspective view of the exemplary casing assembly of FIG. 3.
Figure 6:
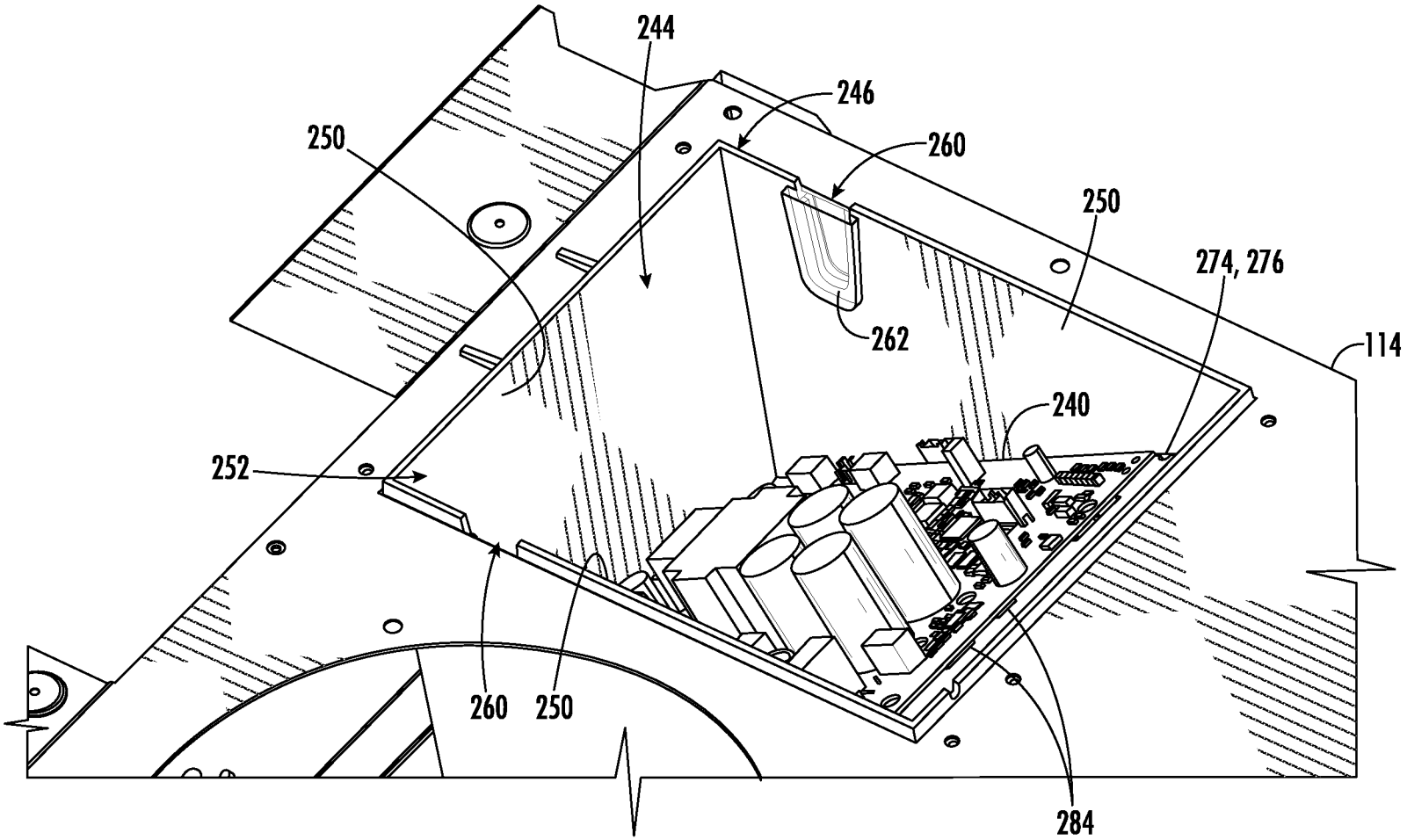
FIG. 6 provides a top perspective view of the exemplary casing assembly of FIG. 3, wherein the lid has been removed for clarity.
Figure 7:
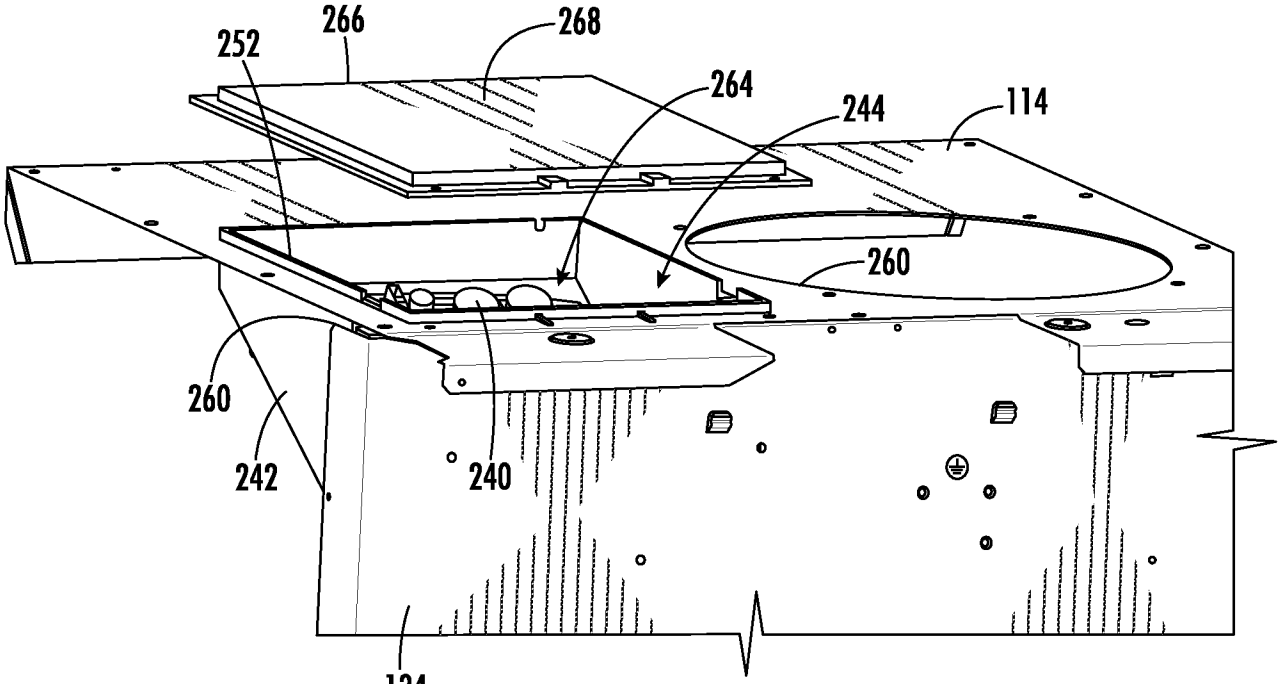
FIG. 7 provides a side perspective view of the exemplary casing assembly of FIG. 3, wherein the lid has been held above the electronics casing for clarity.
Figure 8:
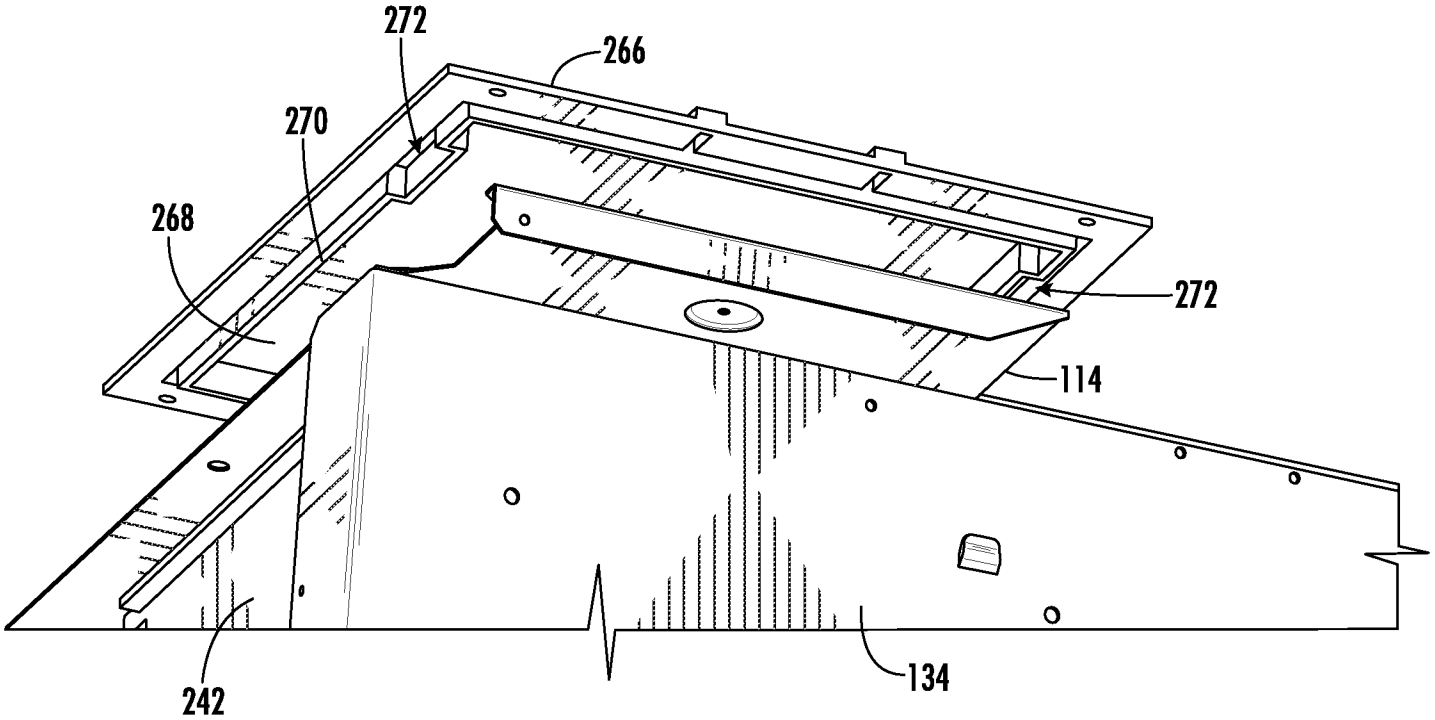
FIG. 8 provides a bottom perspective view of the exemplary casing assembly of FIG. 3, wherein the lid has been held above the electronics casing for clarity.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Turning now to the figures, FIG. 1 and illustrate an exemplary air conditioner appliance (e.g., air conditioner 100). As shown, air conditioner 100 may be provided as a one-unit type air conditioner 100, such as a single-package vertical unit. Generally, air conditioner 100 defines a vertical direction V, lateral direction L, and transverse direction T. Each direction V, L, T is perpendicular to each other, such that an orthogonal coordinate system is generally defined.

Air conditioner 100 includes a package housing or cabinet 114 supporting an indoor portion 112 and an outdoor portion 110. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that housing 114 does not necessarily require an enclosure and may simply include open structure supporting various elements of appliance 100. By contrast, housing 114 may enclose some or all portions of an interior of housing 114. It should be appreciated that housing 114 may have any suitable size, shape, and configuration while remaining within the scope of the present subject matter.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, a blower fan 142, and a heating unit. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

During certain operations, air may be drawn to indoor portion 112 through front opening 118. Specifically, an indoor inlet 138 defined through housing 114 may receive indoor air motivated by blower fan 142. At least a portion of the indoor air may be motivated through or across indoor heat exchanger 122 (e.g., before passing to bulkhead 134). From blower fan 142, indoor air may be motivated (e.g., across heating unit) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

A plenum 166 may be provided to direct air to or from housing 114. When installed, plenum 166 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). For instance, plenum 166 may extend (e.g., parallel to the transverse direction T) through a hole or channel 152 in the structure wall 150 that passes from an internal surface 154 to an external surface 156.

In some embodiments, a make-up air assembly 200 is provided to selectively direct outdoor or make-up air to the indoor portion 112. Specifically, make-up air assembly 200 may direct outdoor air through the structure outer or wall 150 of the structure within which air conditioner 100 is installed (e.g., via plenum 166) and to indoor heat exchanger 122 without first directing such outdoor or make-up air through housing 114. To that end, make-up air assembly 200 may include one or more air ducts or conduits (e.g., intake conduit 210 or secondary air duct 212) defining one or more air paths outside of housing 114. During use, the flow of make-up air may thus be fluidly isolated from the flow of air through outdoor portion 110.

The operation of air conditioner 100 including compressor 126 (and thus the sealed system generally), blower fan 142, outdoor fan 124, heating unit, and other suitable components may be controlled by a controller 158 (e.g., control board, inverter board, etc.). Controller 158 may be in communication (via for example a suitable wired or wireless connection) to such components of the air conditioner 100. By way of example, the controller 158 may include one or more electronics boards (e.g., mounted together or separately within housing 114). In some embodiments, controller 158 includes a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH. Optionally, controller 158 may include one or more electronic components (e.g., provided on an inverter board) for powering components to which the controller 158 is in communication with. Thus, controller 158 may facilitate or direct the change of a current between a direct and alternating current, as would be understood.

Generally, controller 158 may be mounted at any suitable location on or within housing 114. In particular, at least one electronics board 240 (e.g., such as a control board or inverter board of controller 158) may be housed or mounted within an electronics casing 242, as will be described in greater detail below. In some embodiments, electronics casing 242 is disposed apart from indoor portion 112 within outdoor portion 110. For instance, electronics casing 242 may be spaced apart from (e.g., above) outdoor heat exchanger 120. As shown, electronics casing 242 may be secured on or supported by one or more internal panels of air conditioner 100. In exemplary embodiments, electronics casing 242 is mounted to, or partially formed by, bulkhead 134 (e.g., opposite of indoor fan 142). In additional or alternative embodiments, electronics casing 242 is mounted to, or partially formed by, an outer panel of housing 114 (e.g., a top end of housing 114 or outdoor portion 110).

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Turning now especially to FIGS. 3 through 8, electronics casing 242 may be held or mounted on one or more panels within outdoor portion 110, as noted above. Electronics casing 242 itself may extend along the vertical direction V between a top casing end 246 and a bottom casing end 248. When assembled, bottom casing end 248 may be held within outdoor portion 110. Additionally or alternatively, top casing end 246 may be held at or above outdoor portion 110. For instance, top casing end 246 may be held above a top wall of housing 114 (e.g., through which electronics casing 242 is mounted).

Between the top casing end 246 and a bottom casing end 248, electronics casing 242 defines a board chamber 244. Specifically, one or more casing walls (e.g., sidewalls 250, angled casing wall 254, etc.) may define board chamber 244 as a separate or discrete chamber within outdoor portion 110 and within which electronics board 240 may be mounted. As shown, a plurality of sidewalls 250 may define a vertical opening 252 (e.g., at top casing end 246) through which a user or service person may access board chamber 244, such as to install, remove, or service electronics board 240. Thus, the plurality of sidewalls 250 may form an upper edge or perimeter of electronics casing 242. Optionally, the vertical opening 252 may be open or extend through housing 114, such as through a top wall of housing 114. In turn, board chamber 244 may notably be accessible (e.g., to a user or service person) without requiring disassembly of housing 114 or otherwise forcing a user to access the region of outdoor portion 110 that surrounds electronics casing 242. As noted above, top casing end 246 may be held above a top wall of the housing 114. In some such embodiments, the upper edge or perimeter of electronics casing 242 may thus extend above an exterior surface of the housing 114, advantageously restricting water flow (e.g., horizontal water flow) to the vertical opening 252.

In certain embodiments, one or more of the sidewalls 250 extend along (e.g., parallel to) the vertical direction V. In other words, one or more of the sidewalls 250 may form one or more planar surfaces (e.g., exterior or interior surface) that lie in a plane parallel to the vertical direction V. In the illustrated embodiments, the plurality of sidewalls 250 include at least a portion of bulkhead 134 and multiple other sidewalls 250 formed from a single continuous or integral panel. Nonetheless, it is understood that alternative embodiments may include a plurality of discrete walls joined together, as would be understood.

Separate from or in addition to the plurality of sidewalls 250, the electronics casing 242 may include an angled casing wall 254. As shown, angled casing wall 254 extends along a wall angle θ that is non-orthogonal and non-parallel relative to the vertical direction V. In other words, angled casing wall 254 may form one or more planar surfaces (e.g., exterior or interior surface) that lie in a plane on the wall angle θ. Optionally, the wall angle θ may be between approximately 30° and 60° (e.g., relative to the vertical direction V). Additionally or alternatively, the wall angle θ may be approximately 45°.

Generally, angled casing wall 254 is held between the top casing end 246 and the bottom casing end 248. In some embodiments, angled casing wall 254 extends to the bottom casing end 248. Angled casing wall 254 may extend (e.g., generally downward) from one of the plurality of sidewalls 250. For instance, relative to the vertical direction V, angled casing wall 254 (or wall angle θ) may extend from one of the plurality of sidewalls 250 to bottom casing end 248 (or a bottom wall provided at the same). Optionally, angled casing wall 254 may extend downward toward the indoor portion 112. In other words, angled casing wall 254 may descend along the vertical direction V relative to proximity to indoor portion 112 (e.g., relative to the transverse direction T). Additionally or alternatively, relative to a horizontal direction (e.g., lateral direction L), angled casing wall 254 may extend between multiple (e.g., opposing) sidewalls 250. Moisture entering the board chamber 244 may thus be directed along the sidewalls 250 and down the angled casing wall 254 (e.g., toward the bottom casing end 248).

In optional embodiments, an arched interior ridge 256 is disposed on angled casing wall 254. In particular, arched interior ridge 256 may be disposed on angled casing wall 254 within board chamber 244. Thus, arched interior ridge 256 may be mounted to or formed with an interior surface 264 of angled casing wall 254 (e.g., as a vertically raised rim or groove). As shown, arched interior ridge 256 may be arched upward to form a convex curve or arc shape. The terminal points of the arched interior ridge 256 may thus be located proximal to the bottom of angled casing wall 254 (e.g., proximal to bottom casing end 248) relative or in comparison to the crest of arched interior ridge 256. Moreover, the terminal points of the arched interior ridge 256 may be spaced apart (e.g., horizontally) from the sidewalls 250 (e.g., opposing sidewalls 250) of electronics casing 242. Liquids flowing along angled casing wall 254 may thus be directed to flow outward toward the terminal points as such water flows downward and, for example, between a terminal point and an opposing sidewall 250.

In some embodiments, electronics casing 242 defines a weep hole 258. Generally, weep hole 258 may extend through on or more of the casing walls. Specifically, weep hole 258 may extend from board chamber 244 to the outdoor portion 110. For instance, weep hole 258 may extend (e.g., vertically) through bottom wall. Additionally or alternatively, weep hole 258 may be defined at bottom casing end 248. Thus, liquids or water within electronics casing 242 may be permitted to pass from board chamber 244 (e.g., to outdoor portion 110 as motivated by gravity).

Separate from or in addition to the weep hole 258, electronics casing 242 may define one or more horizontal channels 260 extending through one or more of the casing walls. For instance, one or more of the sidewalls 250 may define a horizontal channel 260 extending therethrough. In some such embodiments, the horizontal channel 260 (e.g., channels) may be defined at the top casing end 246. Optionally, the horizontal channel 260 may be open along the vertical direction V and, thus, interrupt the upper edge or perimeter of vertical opening 252. Additionally or alternatively, an enlarged harness grommet 262 may be disposed within the corresponding sidewall 250. For instance, harness grommet 262 may be seated within or directly beneath horizontal channel 260. Harness grommet 262 may extend into board chamber 244 and, thus, further inward than an interior surface of the corresponding sidewall 250. When assembled, harness grommet 262 may be held against an interior surface of housing 114 (e.g., a lower surface of a top wall of housing 114). A portion of horizontal channel 260 or the upper edge or perimeter of the sidewalls 250 may, by contrast, be held above an exterior surface of housing 114 (e.g., an upper surface of a top wall of housing 114). Optionally, a portion of grommet 262 may extend upward (e.g., within horizontal channel 260) from a portion below a top wall of housing 114 to a portion above the top wall of housing 114.

A casing lid 266 may be provided to selectively cover the vertical opening 252. As shown, casing lid 266 may generally include an upper platform 268 that can be alternately placed over vertical opening 252 (e.g., to cover vertical opening 252 and restrict access to board chamber 244) and apart from vertical opening 252 (e.g., to uncover vertical opening 252 and permit access to board chamber 244). In some embodiments, casing lid 266 may be removably disposed on housing 114 (e.g., a top wall of housing 114). For instance, a bottom surface of upper platform 268 may rest on the upper edge or perimeter of the vertical opening 252 above housing 114.

An internal rim 270 may be included with casing lid 266. Specifically, internal rim 270 may extend downward from upper platform 268 (e.g., generally along the vertical direction V as defined when casing lid 266 covers vertical opening 252). In some embodiments, internal rim 270 further extends around at least a portion of the plurality of sidewalls 250 (e.g., radially inward therefrom). Thus, internal rim 270 may follow the upper edge or perimeter formed by vertical opening 252. Moreover, internal rim 270 may seat casing lid 266 over vertical opening 252. Optionally, casing lid 266 or vertical opening 252 may be free of any corresponding gasket or O-ring to seal the board chamber 244.

In certain embodiments, internal rim 270 is spaced apart from horizontal channel 260. For instance, internal rim 270 may be redirected, interrupted, or simply defined apart from a lowermost edge of horizontal channel 260. Optionally, a notch 272 may be defined by internal rim 270, such as to extend radially inward. In some such embodiments, notch 272 is matched to the harness grommet 262. When assembled, the corresponding harness grommet 262 may in turn be received within the notch 272. Thus, the harness grommet 262 may be mated to the internal rim 270, blocking water through horizontal channel 260.

A metal heat sink 274 is provided in certain embodiments to facilitate heat transfer from board chamber 244. Specifically, metal heat sink 274 may be mounted to the angled casing wall 254 (e.g., via one or more mechanical fasteners, adhesives, welds, etc.). In some such embodiments, metal heat sink 274 includes a sink platter 276 that is disposed within board chamber 244. Optionally, a heat transfer or sink aperture 278 is defined through angled casing wall 254 to permit convective heat transfer across metal heat sink 274. Although sink aperture 278 extends through angled casing wall 254, metal heat sink 274 may cover the same. For instance, sink platter 276 may form a lap joint rim 280 that is larger or disposed outward from sink aperture 278. Moreover, lap joint rim 280 may be disposed against an interior surface 264 of angled casing wall 254, thereby restricting water through sink aperture 278. Optionally, sink aperture 278 or lap joint rim 280 may be free of any corresponding gasket or O-ring to seal the board chamber 244.

In optional embodiments, metal heat sink 274 includes a plurality of fins 282. As shown, the plurality of fins 282 may extend away from board chamber 244. For instance, the plurality of fins 282 may extend from the sink platter 276 through sink aperture 278. As a result, the plurality of fins 282 may be exposed to the surrounding region of outdoor portion 110 (e.g., to exchange heat therewith). In some such embodiments, the plurality of fins 282 are inward from (e.g., surrounded by) the lap joint rim 280, which may thus be disposed around the plurality of fins 282. The plurality of fins 282 may extend in parallel to each other (e.g., such that the plurality of fins 282 are spaced apart from each other and do not directly touch an adjacent fin). Additionally or alternatively, the plurality of fins 282 may extend parallel to the angled casing wall 254 (e.g., along the wall angle θ). Water passing along the exterior of electronics casing 242 may thus be directed downward along the wall angle θ or angled casing wall 254.

Within the board chamber 244, an electronics board 240 may be mounted, as generally indicated above. In particular, electronics board 240 may be mounted in thermal communication (e.g., conductive thermal communication) with metal heat sink 274 (e.g., at the sink platter 276). Electronics board 240 may be held directly on metal heat sink 274 or, alternatively, connected to the same via one or more conductive elements. Optionally, a plurality of standoffs 284 may hold the electronics board 240 to the metal heat sink 274. As shown, electronics board 240 may be located directly beneath vertical opening 252. Additionally or alternatively, electronics board 240 may be spaced apart from the plurality of sidewalls 250. In embodiments wherein the arched interior ridge 256 is provided, electronics board 240 may be spaced apart from arched interior ridge 256 (e.g., proximal to bottom casing end 248 relative to arched interior ridge 256). In other words, arched interior ridge 256 may be disposed on the angled casing wall 254 above the electronics board 240. Moreover, electronics board 240 may be inward from arched interior ridge 256. Thus, the terminal ends of arched interior ridge 256 may be disposed closer to opposing sidewalls 250 than electronics board 240. Water within board chamber 244 may, in turn, be notably directed around electronics board 240 if not beneath the same.

Advantageously, appliances or assemblies in accordance with the present disclosure may ensure reliable heat transfer from electronics board 240 to the region of outdoor portion (e.g., without requiring any sealing or resilient gasket, O-ring, foam, etc.). Moreover, such may be provided in a notably reliable, low-cost, or easily assembled manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

an electronics casing disposed in the outdoor portion apart from the outdoor heat exchanger, the electronics casing defining a board chamber and comprising an angled casing wall extending along a wall angle that is non-orthogonal and non-parallel relative to the vertical direction;

a metal heat sink comprising a plurality of fins mounted to the angled casing wall and extending away from the board chamber; and an electronics board mounted within the board chamber in thermal communication with the metal heat sink.

2. The single-package air conditioner unit of claim 1, wherein the electronics casing further defines a weep hole extending from the board chamber to the outdoor portion at a bottom casing end to permit liquids to pass from the board chamber.

3. The single-package air conditioner unit of claim 1, wherein the electronics casing further defines a vertical opening above the board chamber to permit access thereto.

4. The single-package air conditioner unit of claim 1, wherein the angled casing wall is downward toward the indoor portion.

5. The single-package air conditioner unit of claim 1, wherein the board chamber further comprises an arched interior ridge disposed on the angled casing wall within the board chamber above the electronics board.

6. The single-package air conditioner unit of claim 1, wherein the electronics casing comprises a sidewall defining a horizontal channel at a top casing end, and wherein the electronics casing further comprises a harness grommet extending from the horizontal channel to the board chamber.

7. The single-package air conditioner unit of claim 6, further comprising a casing lid selectively covering a vertical opening to the board chamber, the casing lid comprising an upper platform and an internal rim extending downward from the upper platform, the internal rim defining a notch matched to the harness grommet to receive the harness grommet.

8. The single-package air conditioner unit of claim 1, wherein the plurality of fins extend in parallel to the angled casing wall.

9. The single-package air conditioner unit of claim 1, wherein the angled casing wall defines a sink aperture through which the plurality of fins extend, and wherein the metal heat sink further comprises a lap joint rim disposed about the plurality of fins against an interior surface of the electronics casing.

10. The single-package air conditioner unit of claim 1, further comprising a plurality of standoffs holding the electronics board to the metal heat sink.

11. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

an electronics casing disposed in the outdoor portion apart from the outdoor heat exchanger, the electronics casing extending along the vertical direction between a top casing end and a bottom casing end, the electronics casing defining a board chamber between the top casing end and the bottom casing end, the electronics casing comprising a plurality of sidewalls defining a vertical opening and a horizontal channel at the top casing end, the vertical opening permitting access to the electronics casing, the electronics casing further defining a weep hole extending from the board chamber to the outdoor portion at the bottom casing end to permit liquids to pass from the board chamber;

a casing lid selectively covering the vertical opening, the casing lid comprising an upper platform and an internal rim extending downward from the upper platform along the plurality of sidewalls; and an electronics board mounted within the board chamber.

12. The single-package air conditioner unit of claim 11, wherein the electronics casing further defines a weep hole extending from the board chamber to the outdoor portion at the bottom casing end to permit liquids to pass from the board chamber.

13. The single-package air conditioner unit of claim 11, wherein the electronics casing further defines a vertical opening above the board chamber to permit access thereto.

14. The single-package air conditioner unit of claim 11, wherein the electronics casing comprises an angled casing wall extending downward toward the indoor portion.

15. The single-package air conditioner unit of claim 14, wherein the board chamber further comprises an arched interior ridge disposed on the angled casing wall within the board chamber above the electronics board.

16. The single-package air conditioner unit of claim 14, further comprising a plurality of fins extending in parallel to the angled casing wall.

17. The single-package air conditioner unit of claim 16, wherein the angled casing wall defines a sink aperture through which the plurality of fins extend, further comprising a lap joint rim disposed about the plurality of fins against an interior surface of the electronics casing.

18. The single-package air conditioner unit of claim 11, wherein the electronics casing comprises a sidewall defining a horizontal channel at the top casing end, and wherein the electronics casing further comprises a harness grommet extending from the horizontal channel to the board chamber.

19. The single-package air conditioner unit of claim 18, wherein the internal rim defines a notch matched to the harness grommet to receive the harness grommet.

20. The single-package air conditioner unit of claim 11, further comprising a metal heat sink in thermal communication with the electronics board and a plurality of standoffs holding the electronics board to the metal heat sink.

* * * * *